US006688568B1

(12) United States Patent
Moufflet

(10) Patent No.: US 6,688,568 B1
(45) Date of Patent: Feb. 10, 2004

(54) FIXING DEVICE COMPRISING A ROD HOOKED ON A WALL

(75) Inventor: Claude Moufflet, Saint-Lambert des Bois (FR)

(73) Assignee: Groupe SMS, Trappes (FR)

( * ) Notice: Subject to any disclaimer, the term of this patent is extended or adjusted under 35 U.S.C. 154(b) by 0 days.

(21) Appl. No.: 09/890,369

(22) PCT Filed: Feb. 10, 2000

(86) PCT No.: PCT/FR00/00336

§ 371 (c)(1),
(2), (4) Date: Jul. 30, 2001

(87) PCT Pub. No.: WO00/48486

PCT Pub. Date: Aug. 24, 2000

(30) Foreign Application Priority Data

Feb. 19, 1999 (FR) ..... 99 02096

(51) Int. Cl.[7] ..... A47B 96/00

(52) U.S. Cl. ..... 248/225.11; 248/322; 248/323; 248/327; 248/223.41; 211/59.1; 211/103

(58) Field of Search ..... 248/327, 225.11, 248/225.21, 220.22, 317, 322, 339, 223.41, 224.8, 323; 211/94.01, 87.01, 113, 59.1, 103; 16/404; 108/152, 108, 144.11; 312/245

(56) References Cited

U.S. PATENT DOCUMENTS

| | | | | | |
|---|---|---|---|---|---|
| 3,321,090 | A | * | 5/1967 | Greenstadt | 211/162 |
| 3,944,180 | A | * | 3/1976 | Rogers | 248/323 |
| 4,211,379 | A | | 7/1980 | Morgan et al. | |
| 4,592,527 | A | * | 6/1986 | Karapita | 248/318 |
| 4,694,965 | A | * | 9/1987 | Parnell | 211/87 |
| 4,779,830 | A | * | 10/1988 | Phelps | 248/250 |
| 5,228,579 | A | * | 7/1993 | Kaufman | 211/94 |
| 5,472,167 | A | * | 12/1995 | Shillington et al. | 248/552 |

FOREIGN PATENT DOCUMENTS

| | | |
|---|---|---|
| DE | P28 38 285.6 | 9/1978 |
| DE | 28 38 285 | 3/1980 |

* cited by examiner

*Primary Examiner*—Kimberly Wood
(74) *Attorney, Agent, or Firm*—Myron Greenspan, Esq.; Lackenbach Siegel, LLP

(57) ABSTRACT

The invention concerns a fixing device comprising a vertical rod (10) used for fixing an object in front of a wall (2) hanging from a horizontal rail (1) by it top end zone (12) which is deformed so as to co-operate with the rail to maintain the rod stable by the effect of its own weight.

17 Claims, 2 Drawing Sheets

FIXING DEVICE COMPRISING A ROD HOOKED ON A WALL

The invention relates to a device for detachable and adjustable fixing of objects, comprising at least one rod, one upper end region of which can be connected to a substantially vertical wall, by means of an anchorage part which is fixed integrally to the latter, and detachable hooking parts, each of which can be fitted at an adjustable height on the said rod, in a main region of the latter, which extends substantially vertically and in a straight line.

A device of this type is described in EP 0 429 339 A. This known device requires additional anchorage of the lower end region of the rod, to the vertical wall or to the ground, a brace to space the main region of the rod from the vertical wall, and flexible connections, to connect this main region to the upper end region, by means of an oblique region. The upper end of the rod is screwed into the anchorage part.

The main object of the invention is to simplify the device and the operations which are necessary in order to put it into place.

Another object is to permit continuous adjustment of the position of the rod along the vertical wall.

The invention relates in particular to a device of the type defined in the introduction, and according to which the said upper end region comprises an upper section and a lower section, which are offset from one another both according to the direction of the main region, and transversely to this direction, and are connected to one another by an intermediate section, and the anchorage part has a first support surface which is turned towards the said wall, a second support surface which is turned upwards, and a third support surface which is turned opposite the said wall, which can co-operate with intermediate section, and of the lower section respectively, in order to assure stable fixing of the rod, by simple suspension on the anchorage part, under the effect of its own weight, and, if applicable, that of the objects which it supports.

Optional, additional or alternative characteristics of the invention are described hereinafter:

The said first support surface on the one hand, and the said second and third support surfaces on the other hand, belong to parts of the anchorage part which are separated from one another by an aperture, which permits introduction of the upper section in an inner cavity of the anchorage part, by movement of translation of the rod which is oriented obliquely, and movement of pivoting towards a vertical orientation, during and/or after the said movement of translation, which makes it possible to bring the said support surfaces into co-operation with their respective conjugated surfaces.

The said second support surface and its conjugated surface are substantially flat and horizontal.

The anchorage part is symmetrical relative to a horizontal plane.

The said lower section is substantially aligned with the main region.

The said parts of the anchorage part are two wings, which extend towards one another from respective cross-members, which connect them to a base which is applied to the wall.

The said wings extend substantially according to a single vertical plane.

The anchorage part is a profiled rail, which can be fixed horizontally along the wall, and can receive one or a plurality of rods, in continuously adjustable positions, in its longitudinal direction.

The characteristics and advantages of the invention will be described in greater detail in the following description, with reference to the attached drawings.

Figure 1:
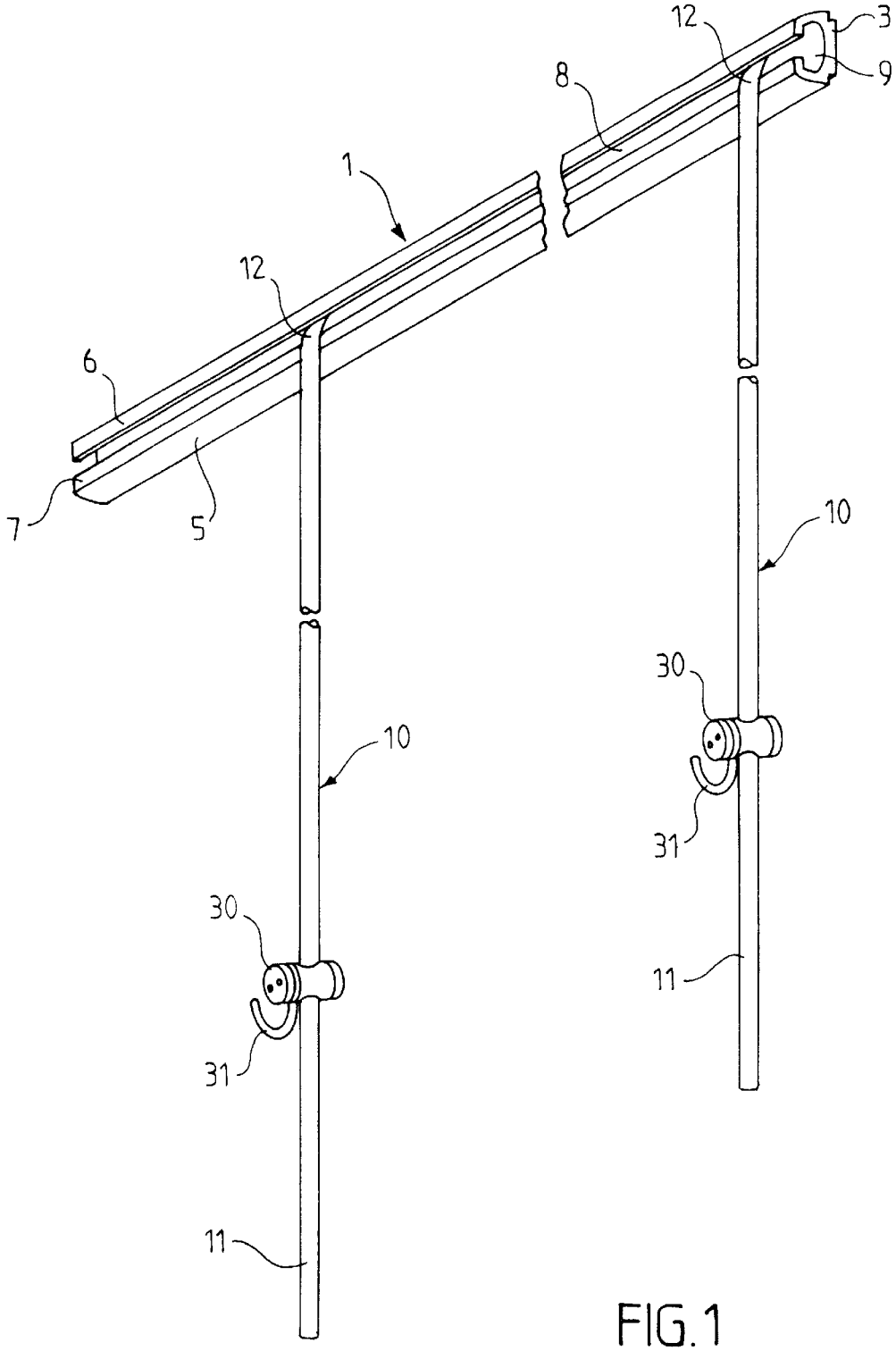
FIG. 1 is a perspective view of a device according to the invention, fixed to a wall.

The device represented comprises a rail 1, which extends horizontally along a vertical wall 2. The rail 1 has a C-shaped profile, the back 3 of which is applied, and fixed by means not represented such as screws, to the wall 2. Each of the upper and lower branches of the profile defines a cross-member 4, 5 and a wing 6, 7, each cross-member connecting the corresponding wing to the back, and the two wings extending towards one another, according to a single vertical plane, from their respective cross-member, leaving between one another an aperture 8 in the form of a longitudinal slot, by means of which the inner cavity 9 of the rail communicates with the exterior.

Figure 3:
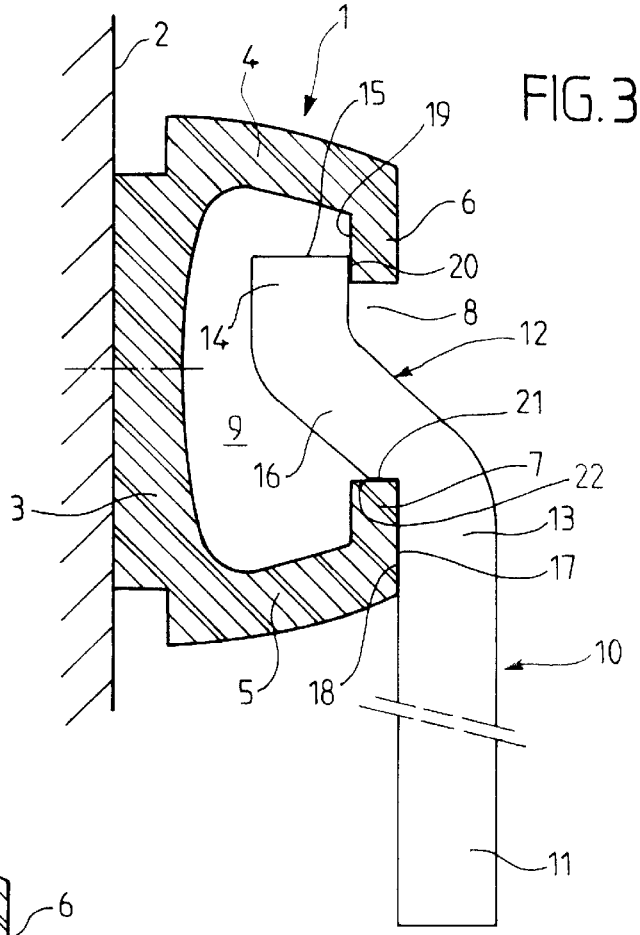
FIG. 3 is a lateral view of the device, showing the anchorage rail in cross-section.

In FIG. 1 there are represented two identical rods 10, which are suspended on the rail 1, and are offset from one another in the longitudinal direction of the latter. Each rod comprises a vertical straight main region 11, and an upper end region 12, which can be seen better in FIG. 3, and has the general shape of an S. The region 12 consists of a lower section 13, which extends vertically in alignment with the region 11, in front of the lower wing 7 of the rail, i.e. opposite the latter relative to the wall 2, an upper section 14, which is adjacent to the upper end 15 of the rod, and extends vertically inside the cavity 9, and an intermediate section 16, which extends obliquely, and connects the sections 13 and 14 to one another. The flat, vertical outer surface 17 of the wing 7 acts as a support surface for a corresponding surface 18 of the section 13. The flat, vertical inner surface 19 of the wing 6 acts as a support surface for a corresponding surface 20 of the section 14. The flat, horizontal upper edge 21 of the wing 7 acts as a support surface for a corresponding flat, horizontal surface of the section 16. The co-operation of these surfaces prevents any displacement of the rod downwards, and any pivoting which tends to bring its main region 11 close to the wall. The weight of the rod, and, if applicable, of the objects fitted on the latter as described hereinafter, prevents it from rising, and from pivoting such that its main region moves away from the wall. The rod is thus maintained stably on the rail, without needing added fixing means or screwing operations.

In the example illustrated, the rail 1 is symmetrical relative to a horizontal plane, which prevents any error of orientation when it is secured to the wall.

The main region 11 of the rod 10 advantageously has a shape which is cylindrical in revolution. The end region 12 can be obtained by deformation, from a rod which initially has full revolution. The flat surface 22 and at least a flat part of the surface 18 can be obtained by means of the tooling which is used for this deformation, or by subsequent machining.

Figure 4:
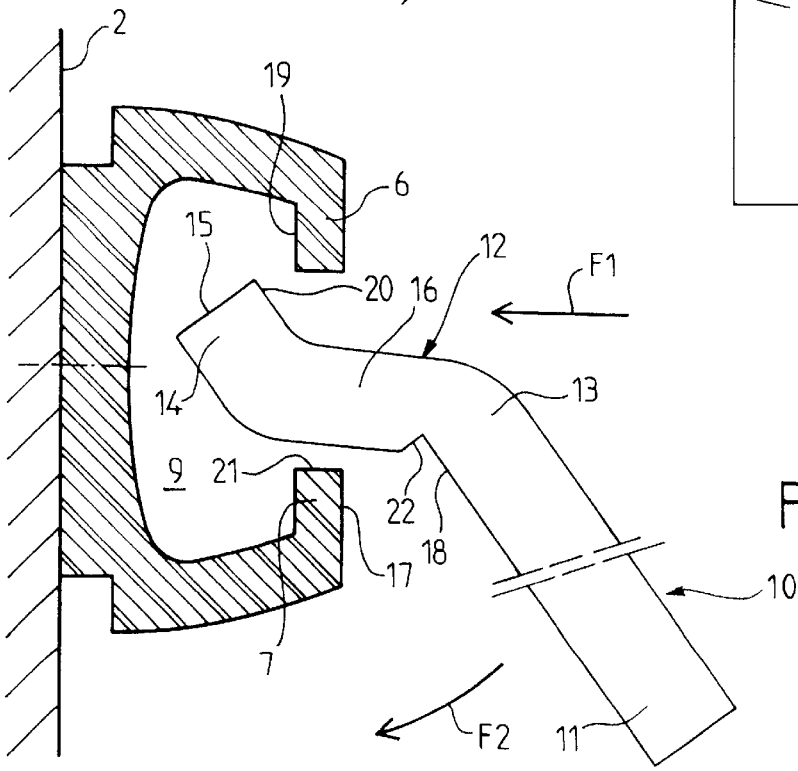
FIG. 4 is a view similar to FIG. 3, showing a rod as it is being put into place.

It can be seen in FIG. 4 that the upper section 14 can be inserted in the cavity 9, through the slot 8, by movement of translation of the rod 10 which is oriented obliquely, this movement of translation taking place for example horizontally according to the arrow F1. The end of this movement of translation is accompanied or followed by a movement of pivoting according to the arrow F2, which brings the rod into its final vertical orientation, and brings the support surfaces 17, 19 and 21 into co-operation with their respective conjugated surfaces 18, 20 and 22.

Figure 2:
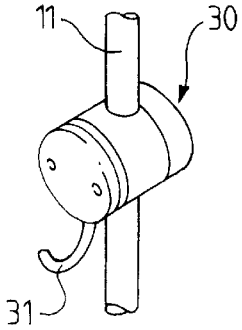
FIG. 2 is a partial perspective view showing a hooking part, and the area of the rod on which it is fitted.

FIG. 1 also shows two identical hooking parts 30, which are fitted respectively on the rods 10. These parts, which in themselves are known, and one of which is represented in greater detail in FIG. 2, can be fitted on the rods in a continuously adjustable position along the latter, by means described in FR 2 627 241 A. They comprise a hook 31 which makes it possible to hook objects on them.

The device according to FIG. 1 can be used in particular as dado unit in order to hook a painting on the wall. The number of the rods 10 and their spacing from one another can be varied as required, according to the size and weight of the painting. The parts 30 can be replaced by hooking parts of a different type, such as the various parts described in FR 2 407 691 A and FR 2 627 241 A, according to the nature of the objects to be hung. It will be appreciated that a plurality of objects can be supported by respective rods or sets of respective rods, all the rods being suspended on a single rail, or on mutually aligned rails.

If it is not wished to have the possibility of adjusting the position of the rods along the wall, for each rod a short anchorage part, fixed in the required position, can be used instead of a rail.

Instead of being aligned with its main region, the lower section of the upper region of the rod can be offset horizontally relative to the latter, for example in order to space the objects to be hooked, from the wall.

What is claimed is:

1. A device for detachable and adjustable fixing of objects, comprising:

a least one substantially vertical rod (10), having one upper end region (12) which can be connected to a substantially vertically wall (2), by means of an anchorage part (1) which is fixed integrally to the wall;

detachable hooking parts (30), each of which can be fitted at an adjustable height on said rod;

said upper end region comprising:

an upper section (14) and a lower section (13), which are offset from one another both according to a first direction of a main region (11) of rod (10), and transversely to said first direction, and are connected to one another by an intermediate section (16); and said anchorage part having a first support surface (19) which is turned towards said wall, a second support surface (21) which is turned upwards, and a third support surface (17) which extends opposite said wall, each of which can co-operate with respective conjugated surfaces (20, 22, 18) of the upper section (14), of the intermediate section (16), and of the lower section (13) respectively, in order to assure stable fixing of said rod (10), by suspension on said anchorage part (1), under the weight of said rod.

2. A device as claimed in claim 1, wherein:

said first support surface (19), and said second and said third support surface (21,17), respectively extend along a set of parts (6,7) projecting from said anchorage part opposite said wall separated by an aperture (8); and said aperture (8) permitting an introduction of the upper section (14) into an inner cavity (9) of the anchorage part, by one of at least a first translation movement of the rod obliquely to said aperture, and a second pivoting movement of the rod towards a vertical orientation, thereby making it possible to bring said support surfaces into co-operation with each respective conjugated surface.

3. A device as claimed in claim 1, wherein: said second support surface (21) and its respective conjugated surface (22) are substantially flat and horizontal surfaces.

4. A device as claimed in claim 2, wherein: said second support surface (21) and its conjugated surface (22) are substantially flat and horizontal surfaces.

5. A device as claimed in claim 1, wherein: the anchorage part is symmetrical relative to a horizontal plane extending substantially perpendicular to said rod.

6. A device as claimed in claim 2, wherein: the anchorage part is symmetrical relative to a horizontal plane extending substantially perpendicular to said rod.

7. A device as claimed in claim 3, wherein the anchorage part is symmetrical relative to a horizontal plane extending substantially perpendicular to said rod.

8. A device as claimed in claim 1, wherein: said lower section (13) is substantially aligned with the main region (11).

9. A device as claimed in claim 2, wherein: said lower section (13) is substantially aligned with the main region (11).

10. A device as claimed in claim 3, wherein: said lower section (13) is substantially aligned with the main region (11).

11. A device as claimed in claim 2, wherein: said parts of the anchorage part include two wings (6,7), extending towards one another from a respective set of cross-members (4,5) which connect said wings to a base (3) applicable to the wall.

12. A device as claimed in claim 3, wherein: said parts of the anchorage part include two wings (6,7), extending towards one another from a respective set of cross-members (4, 5) which connect said wings to a base (3) applicable to the wall.

13. A device as claimed in claim 11, wherein: said wings extend substantially along a single vertical plane.

14. A device as claimed in claim 12 wherein: said wings extend substantially along a single vertical plane.

15. A device as claimed in claim 1, wherein the anchorage part is a profiled rail (1), fixable horizontally along the wall (2), and can receive at least one rod (10), in continuously adjustable positions, along its longitudinal direction.

16. A device as claimed in claim 2, wherein: the anchorage part is a profiled rail (1), fixable horizontally along the wall (2), and can receive at least one rod (10), in continuously adjustable positions, along its longitudinal direction.

17. A device as claimed in claim 3, wherein: the anchorage part is a profiled rail (1), fixable horizontally along the wall (2), and can receive at least one rod (10), in continuously adjustable positions, along its longitudinal direction.

* * * * *